US006804371B2

(12) United States Patent
Liu et al.

(10) Patent No.: US 6,804,371 B2
(45) Date of Patent: Oct. 12, 2004

(54) SPEAKER HAVING A LASER VIBRATION DIAPHRAGM

(76) Inventors: Mu-Sheng Liu, 136, 6 Lin, Chung-Yi Tsun, Kung-Kuan Hsiang, Miaoli (TW); Long-Zheng Zhu, 136, 6 Lin, Chung-Yi Tsun, Kung-Kuan Hsiang, Miaoli (TW); Ta-Yan Peng, 136, 6 Lin, Chung-Yi Tsun, Kung-Kuan Hsiang, Miaoli (TW)

( * ) Notice: Subject to any disclaimer, the term of this patent is extended or adjusted under 35 U.S.C. 154(b) by 109 days.

(21) Appl. No.: 10/216,736

(22) Filed: Aug. 13, 2002

(65) Prior Publication Data

US 2004/0032966 A1 Feb. 19, 2004

(51) Int. Cl.[7] ..... H04R 25/00

(52) U.S. Cl. ..... 381/426; 381/160; 381/184; 381/388; 381/423; 181/167; 181/168; 181/170

(58) Field of Search ..... 181/165, 167, 181/168–170; 381/160, 184, 388, 423, 424, 426, 427, 172; 84/464 R; 362/259, 231, 280, 284, 323, 811, 86; 353/15; 359/847; 398/133, 134, 132

(56) References Cited

U.S. PATENT DOCUMENTS

| | | | | |
|---|---|---|---|---|
| 3,590,681 A | * | 7/1971 | Cross | |
| 3,603,195 A | * | 9/1971 | Williams | 84/464 R |
| 4,028,977 A | * | 6/1977 | Ryeczek | |
| 4,198,550 A | * | 4/1980 | Matsuda et al. | 381/354 |
| 4,205,585 A | * | 6/1980 | Hornick | 84/464 R |
| 4,744,625 A | * | 5/1988 | Lanzisera | 359/305 |
| 6,176,345 B1 | * | 1/2001 | Perkins et al. | 181/173 |
| 6,301,034 B1 | * | 10/2001 | Speciale | 398/134 |
| 6,361,188 B1 | * | 3/2002 | Kuts | 362/259 |

* cited by examiner

*Primary Examiner*—Curtis Kuntz
*Assistant Examiner*—Dionne Harvey
(74) *Attorney, Agent, or Firm*—Rosenberg, Klein & Lee

(57) ABSTRACT

A speaker includes a housing having a diffusion opening provided with a laser vibration diaphragm. The laser vibration diaphragm has reflective spatial patterns, so that the speaker may present multiple-image variations under different rays of light, thereby enhancing a viewing effect and aesthetic quality of the speaker. Thus, the laser vibration diaphragm may produce spatial variations by the difference of incident angles of the light, thereby obtaining a viewable strong sensation to the people, and thereby enhancing the viewing effect and aesthetic quality of the speaker.

7 Claims, 3 Drawing Sheets

SPEAKER HAVING A LASER VIBRATION DIAPHRAGM

BACKGROUND OF THE INVENTION

1. Field of the Invention

The present invention relates to a speaker having a laser vibration diaphragm, and more particularly to a speaker having a laser vibration diaphragm that may produce spatial variations by the difference of incident angles of the light, thereby obtaining a viewable strong sensation to the people, and thereby enhancing the viewing effect and aesthetic quality of the speaker.

2. Description of the Related Art

A conventional cabinet 1 shown in FIG. 1 comprises at least one speaker 2 having a vibration diaphragm 3 which is protruded outward from the speaker 2. However, the vibration diaphragm 3 does not have an outstanding appearance, thereby decreasing the aesthetic quality of the speaker 2 and the cabinet 1.

SUMMARY OF THE INVENTION

The present invention has arisen to mitigate and/or obviate the disadvantage of the conventional speaker.

The primary objective of the present invention is to provide a speaker having a laser vibration diaphragm that may produce spatial variations by the difference of incident angles of the light, thereby obtaining a viewable strong sensation to the people, and thereby enhancing the viewing effect and aesthetic quality of the speaker.

In accordance with the present invention, there is provided a speaker having a laser vibration diaphragm, comprising a housing having a diffusion opening provided with a laser vibration diaphragm, wherein the laser vibration diaphragm has reflective spatial patterns, so that the speaker may present multiple-image variations under different rays of light, thereby enhancing a viewing effect and aesthetic quality of the speaker.

Preferably, the laser vibration diaphragm is integrally formed by a plastic injection molding process.

Preferably, the laser vibration diaphragm is formed by metallic material.

Preferably, the laser vibration diaphragm is formed by non-metallic material.

Preferably, the laser vibration diaphragm is formed by bonding.

Preferably, the reflective spatial patterns of the laser vibration diaphragm present a radiating shape.

Preferably, the reflective spatial patterns of the laser vibration diaphragm are formed by multiple concentric circles.

Further benefits and advantages of the present invention will become apparent after a careful reading of the detailed description with appropriate reference to the accompanying drawings.

DETAILED DESCRIPTION OF THE INVENTION

Figure 1:
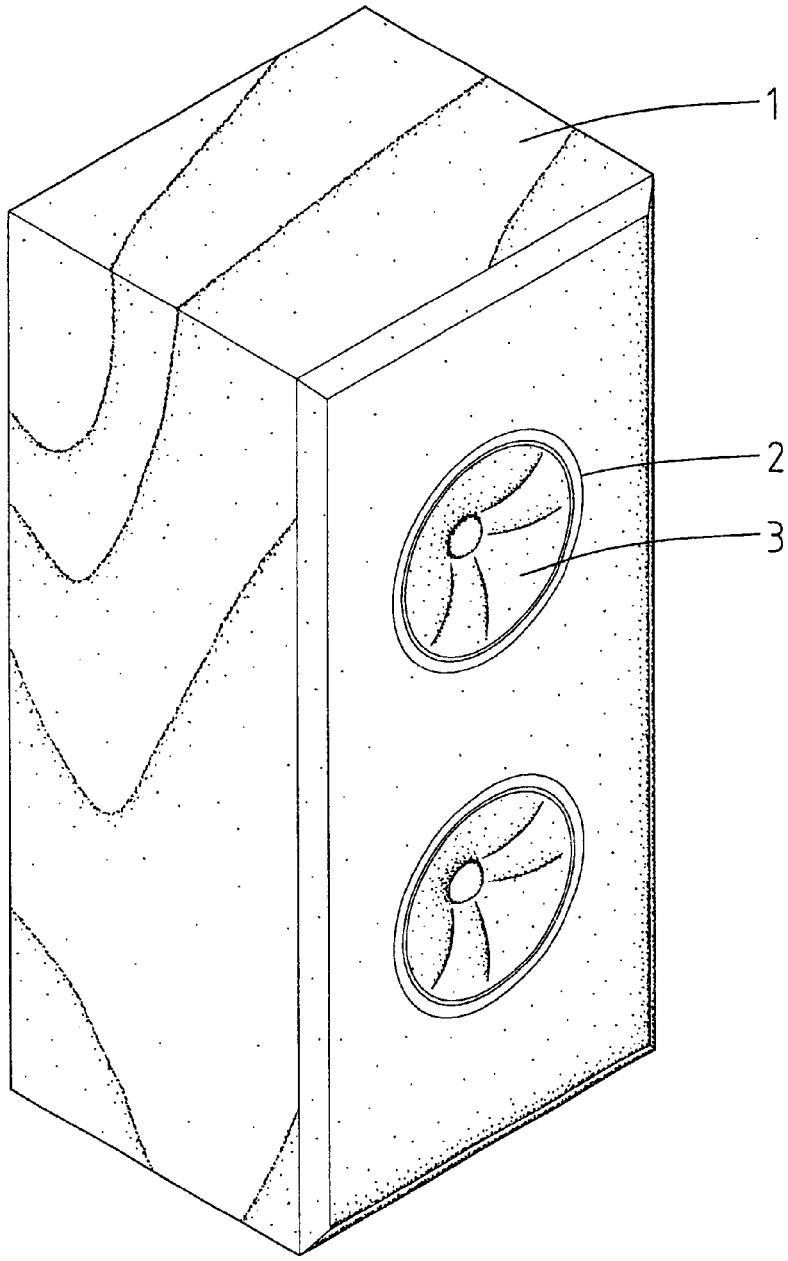
Fig. 1 PRIOR ART
FIG. 1 is a perspective view of a conventional cabinet in accordance with the prior art.
Figure 2:
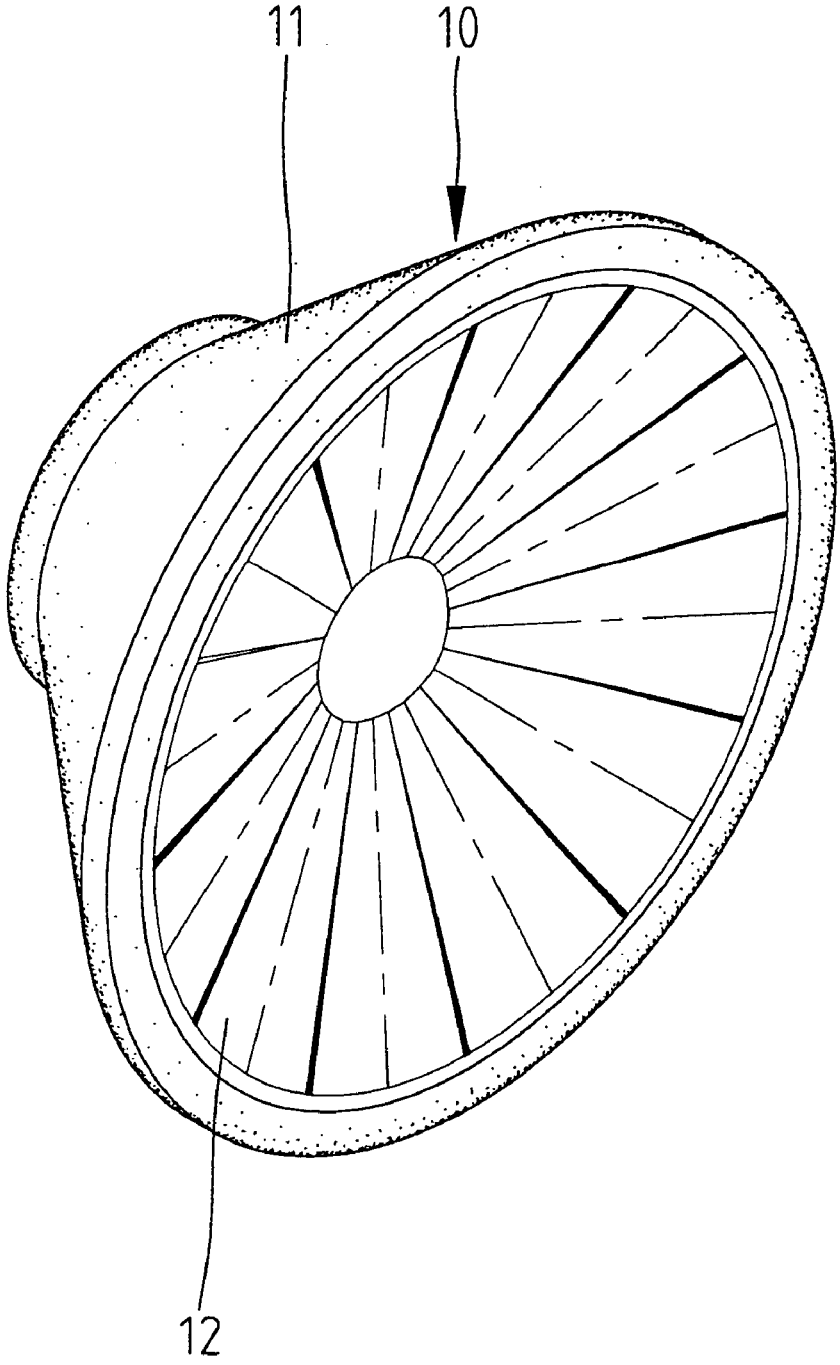
FIG. 2 is a perspective view of a speaker having a laser vibration diaphragm in accordance with a first embodiment of the present invention.

Referring to the drawings and initially to FIG. 2, a speaker 10 having a laser vibration diaphragm in accordance with a first embodiment of the present invention comprises a housing 11 having a diffusion opening provided with an outward exposed type laser vibration diaphragm 12. The laser vibration diaphragm 12 has a pattern presenting a radiating shape.

The laser vibration diaphragm 12 may be formed by bonding metallic material or non-metallic material. Alternatively, the laser vibration diaphragm 12 may be integrally formed by a molding process.

If the laser vibration diaphragm 12 is formed by metallic material, the laser vibration diaphragm 12 may be formed by the forming process of vacuum blowing, chemical resistance, plating compression or the like.

If the laser vibration diaphragm 12 is formed by non-metallic material, such as plastic, paper pulp or the like, the laser vibration diaphragm 12 may be formed by the forming process of vacuum blowing, cooling and heating compressor or the like.

If the laser vibration diaphragm 12 is integrally formed by a molding process, the laser vibration diaphragm 12 may be integrally formed by a plastic injection molding process.

In such a manner, under different rays of light, the laser vibration diaphragm 12 of the speaker 10 may produce spatial variations by the difference of incident angles of the light, thereby obtaining a viewable strong sensation to the people, and thereby enhancing the viewing effect and aesthetic quality of the laser vibration diaphragm 12 of the speaker 10.

Figure 3:
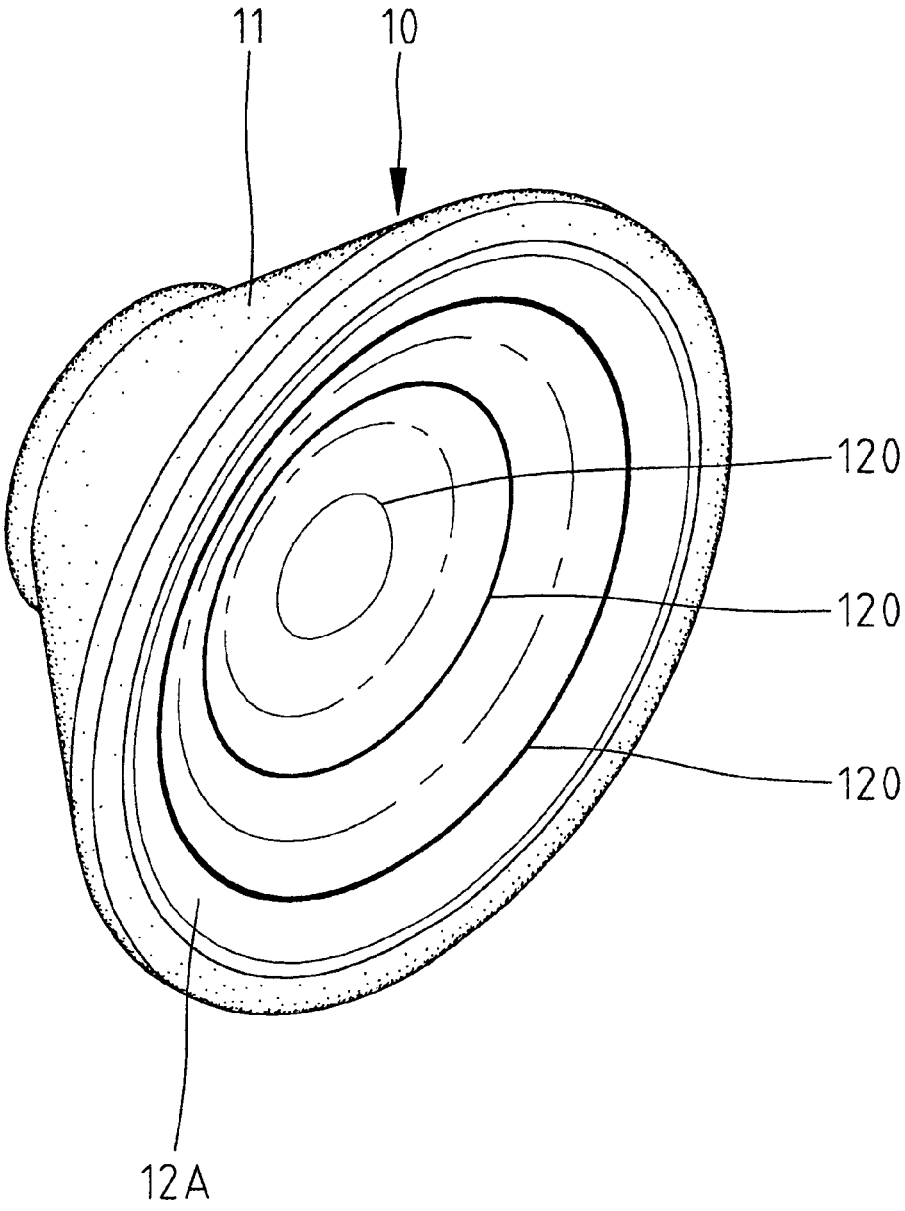
FIG. 3 is a perspective view of a speaker having a laser vibration diaphragm in accordance with a second embodiment of the present invention.

Referring to FIG. 3, a speaker 10 having a laser vibration diaphragm in accordance with a second embodiment of the present invention is shown. Preferably, the laser vibration diaphragm 12A of the speaker 10 includes multiple concentric circles 120 having different sizes, thereby enhancing the viewing effect and aesthetic quality of the laser vibration diaphragm 12A of the speaker 10.

Accordingly, in accordance with the present invention, the laser vibration diaphragm of the speaker may present multiple-image variations under different rays of light, thereby greatly enhancing the viewing effect and aesthetic quality of the speaker.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A speaker having a laser vibration diaphragm, comprising a housing having a diffusion opening provided with a conically extending laser vibration diaphragm for sound generation, wherein the laser vibration diaphragm has reflective spatial patterns formed on a conical surface thereof, whereby the speaker may present multiple-image variations under different rays of light responsive to vibratory deflection of the diaphragm for sound generation, thereby enhancing a viewing effect and aesthetic quality of the speaker.

2. The speaker having a laser vibration diaphragm in accordance with claim 1, wherein the laser vibration diaphragm is integrally formed by a plastic injection molding process.

3. The speaker having a laser vibration diaphragm in accordance with claim 1, wherein the laser vibration diaphragm is formed by metallic material.

4. The speaker having a laser vibration diaphragm in accordance with claim 1, wherein the laser vibration diaphragm is formed by non-metallic material.

5. The speaker having a laser vibration diaphragm in accordance with claim 1, wherein the laser vibration diaphragm is formed by bonding.

6. The speaker having a laser vibration diaphragm in accordance with claim 1, wherein the reflective spatial patterns of the laser vibration diaphragm present a radiating shape.

7. The speaker having a laser vibration diaphragm in accordance with claim 1, wherein the reflective spatial patterns of the laser vibration diaphragm are formed by multiple concentric circles.

* * * * *